US006578620B1

(12) United States Patent
Trudel et al.

(10) Patent No.: US 6,578,620 B1
(45) **Date of Patent: *Jun. 17, 2003**

(54) FILTERING MOLTEN METAL INJECTOR SYSTEM AND METHOD

(75) Inventors: David R. Trudel, Westlake, OH (US); Thomas N. Meyer, Murrysville, PA (US); Michael J. Kinosz, Apollo, PA (US); Guy Arnaud, Morin Heights (CA); Nicolas Bigler, Rivière-Beaudette (CA)

(73) Assignee: Alcoa Inc., Pittsburgh, PA (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/711,667

(22) Filed: Nov. 9, 2000

Related U.S. Application Data

(63) Continuation-in-part of application No. 09/630,781, filed on Aug. 2, 2000, and a continuation-in-part of application No. 09/609,997, filed on Jul. 3, 2000.

(60) Provisional application No. 60/146,827, filed on Aug. 2, 1999, provisional application No. 60/142,218, filed on Jul. 2, 1999, and provisional application No. 60/142,315, filed on Jul. 2, 1999.

(51) Int. Cl.[7] ..... B22D 17/04

(52) U.S. Cl. ..... 164/312; 164/337; 164/134

(58) Field of Search ..... 164/317, 315, 164/133, 113, 135, 306, 312

(56) References Cited

U.S. PATENT DOCUMENTS

| | | | | |
|---|---|---|---|---|
| 2,602,189 A | * | 7/1952 | Finelt | 425/146 |
| 3,999,593 A | * | 12/1976 | Kaiser | 164/55.1 |
| 4,085,791 A | | 4/1978 | Kaiser | 164/55 |

(List continued on next page.)

FOREIGN PATENT DOCUMENTS

| | | | |
|---|---|---|---|
| BE | 446116 | * | 6/1942 |
| DE | 1458001 | | 12/1968 |
| EP | 0381486 | | 8/1990 |
| JP | 7284904 | * | 10/1995 |

OTHER PUBLICATIONS

Patent Abstracts of Japan; Publication No. 07284904, Publication date Oct. 31, 1995; Application date Apr. 21, 1994; Application No. 06082886; entitled "Stoke for Differential Pressure Casting" Applicant Hitachi Metals Ltd; Inventor—Onishi Sanetsugu.

*Primary Examiner*—M. Alexandra Elve
*Assistant Examiner*—Kevin McHenry
(74) *Attorney, Agent, or Firm*—Webb Ziesenheim Logsdon Orkin & Hanson, P.C.

(57) ABSTRACT

The filtering molten metal injector system includes a holder furnace, a casting mold supported above the holder furnace, and at least one molten metal injector supported from a bottom side of the casting mold. The holder furnace contains a supply of molten metal. The mold defines a mold cavity for receiving the molten metal from the holder furnace. The molten metal injector projects into the holder furnace. The molten metal injector includes a cylinder defining a piston cavity housing a reciprocating piston for pumping the molten metal upward from the holder furnace to the mold cavity. The cylinder and piston are at least partially submerged in the molten metal when the holder furnace contains the molten metal. The cylinder or the piston includes a molten metal intake for receiving the molten metal into the piston cavity when the holder furnace contains molten metal. A conduit connects the piston cavity to the mold cavity. A molten metal filter is located in the conduit for filtering the molten metal passing through the conduit during the reciprocating movement of the piston. The molten metal intake may be a valve connected to the cylinder, a gap formed between the piston and an open end of the cylinder, an aperture defined in the sidewall of the cylinder, or a ball check valve incorporated into the piston. A second molten metal filter preferably covers the molten metal intake to the injector.

4 Claims, 7 Drawing Sheets

U.S. PATENT DOCUMENTS 4,262,742 A * 4/1981 James ..... 166/68
4,356,940 A * 11/1982 Ansorge ..... 222/596
4,862,945 A 9/1989 Greanias et al. ..... 164/63
4,961,455 A 10/1990 Redemske et al. ..... 164/63
4,967,827 A * 11/1990 Campbell ..... 164/134
4,991,641 A * 2/1991 Kidd et al. ..... 164/120
5,082,045 A * 1/1992 Lambert ..... 164/113
5,109,914 A * 5/1992 Kidd et al. ..... 164/113
5,181,551 A * 1/1993 Kidd et al. ..... 164/113
5,197,529 A 3/1993 Caugherty ..... 164/113
5,205,346 A 4/1993 Kuhn et al. ..... 164/500
5,244,033 A 9/1993 Ueno ..... 164/312
5,370,171 A 12/1994 Fields et al. ..... 164/312
5,657,812 A * 8/1997 Walter et al. ..... 164/113
5,725,043 A 3/1998 Schaefer et al. ..... 164/119
5,735,333 A 4/1998 Nagawa ..... 164/113
5,792,378 A * 8/1998 Christensen et al. ..... 222/590
5,979,534 A * 11/1999 Shibata et al. ..... 164/113

* cited by examiner

FILTERING MOLTEN METAL INJECTOR SYSTEM AND METHOD

CROSS-REFERENCE TO RELATED APPLICATIONS

This application is a continuation-in-part of U.S. patent application Ser. No. 09/609,997 filed Jul. 3, 2000 entitled "Molten Metal Injector System and Method", which claims the benefit of U.S. Provisional Application Serial Nos. 60/142,218 filed Jul. 2, 1999 entitled "Molten Metal Injector System", and 60/142,315 filed Jul. 2, 1999 entitled "Valveless Molten Metal Injector System"; and a continuation-in-part of U.S. patent application Ser. No. 09/630,781 filed Aug. 2, 2000 entitled "Ball Check Valve Molten Metal Injector System" which claims the benefit of U.S. Provisional Patent Application Serial No. 60/146,827 filed Aug. 2, 1999 entitled "Ball Check Valve Metal Injector System".

STATEMENT REGARDING FEDERALLY FUNDED RESEARCH

The subject matter of this application was made with United States government support under contract number 86X-SU545C awarded by the Department of Energy. The United States government has certain rights to this invention.

BACKGROUND OF THE INVENTION

1. Field of the Invention

The present invention relates to a casting apparatus and method for producing ultra-large, thin-walled components and, more particularly, to a filtering molten metal injector system for producing ultra-large, thin-walled components that includes one or more filtering stages for filtering molten metal in the molten metal injector system.

2. Description of the Prior Art

The manufacturers of ground transportation vehicles, such as automobiles, support utility vehicles, light trucks, vans, buses, and larger capacity trucks have made major efforts in recent years to reduce vehicle weight. Weight reductions increase fuel efficiency and reduce harmful atmospheric emissions of ground transportation vehicles. Presently, a majority of the body components for ground transportation vehicles are formed from individual steel components that are assembled via resistance spot welding. For example, the floor pan frame of an automobile is normally constructed from a number of individual steel stampings that are spot welded together. It would be advantageous to produce such body components as a single, ultra-large casting. As a result, the costs associated with producing and assembling multiple steel stampings would be eliminated. The same technology would also be suitable for components in the aerospace industry.

There are several known methods for producing thin-walled castings. Examples include: high-pressure cold chamber vacuum die casting, premium sand casting, a level pour process practiced by Alcoa Inc. for producing components for the aerospace industry, and low-pressure hot chamber injection. Low-pressure hot chamber injection is particularly well-suited for producing components made from nonferrous metals having a low melting point, such as aluminum, brass, bronze, magnesium, and zinc.

Typical casting arrangements known in the prior art utilize a reciprocating piston located within a cylinder for injecting molten metal into a casting die. For example, U.S. Pat. No. 4,991,641 to Kidd et al. discloses an apparatus that includes a supply tank containing molten metal and a cylinder located in the supply tank having at its base a connection to an injection passageway, which leads through the tank to a casting die located outside the tank. A reciprocating piston is located in the cylinder for injecting molten metal into the injection passageway leading to the casting die. The injecting or pumping stroke of the piston is directed toward the bottom of the supply tank, or during the "downstroke" of the piston. Other prior art casting devices are disclosed in U.S. Pat. No. 5,082,045 to Lambert; U.S. Pat. No. 5,181,551 to Kidd et al.; and U.S. Pat. No. 5,657,812 to Walter et al.

The piston arrangement disclosed, for example, by the Kidd patent, which pumps molten metal during the downstroke of the piston, has a tendency to disturb the metal oxide film surface of the molten metal contained in the supply tank. Consequently, undesirable metal oxides are often pulled into the cylinder from the metal oxide film surface, or formed in the cylinder due to the action of the downward directed piston. These metal oxides are then injected into the casting die along with the molten metal, which results in an inferior cast product. Further, these metal oxides are typically large particles that can score and damage the internal surfaces and seals of the piston-cylinder arrangement, as well as score and damage the injection passageway leading to the casting die. In addition to metal oxide formation, piston arrangements in which the pumping stroke is directed downward in a supply tank of molten metal are known to pull air into the piston cylinder, which forms air pockets in the cylinder. These air pockets, or air bubbles, are injected into the casting die along with the molten metal, which forms occlusions within the cast product. A poor quality final product generally results.

Accordingly, it is an object of the present invention to provide a molten metal injector system for casting of inexpensive, but high-quality thin-walled components of such size and complexity that traditional stamping assemblies made from multiple components could be replaced with a single, ultra-large, thin-walled component. It is another object of the present invention to provide a filtering molten metal injector system and method for reducing or eliminating the introduction of undesirable metal oxides into a casting die used for producing the ultra-large, thin-walled components.

SUMMARY OF THE INVENTION

The above objects are accomplished with a filtering molten metal injector system and method according to the present invention. The present invention combines the advantages of low-pressure, hot chamber molten metal injection with a filtering molten metal injector, which may include multiple molten metal filters for filtering molten metal before injection into a casting mold. The molten metal injector of the present invention includes a holder furnace for containing a supply of molten metal. A casting mold is supported above the holder furnace and has a bottom side facing the holder furnace. The casting mold defines a mold cavity for receiving the molten metal from the holder furnace.

A molten metal injector is supported from the bottom side of the mold and projects into the holder furnace. The molten metal injector includes a cylinder defining a piston cavity housing a reciprocating piston for pumping the molten metal upward from the holder furnace to the mold cavity. The cylinder and piston are at least partially submerged in the molten metal when the holder furnace contains the molten metal. The cylinder or piston includes a molten metal intake for receiving the molten metal into the piston cavity when the holder furnace contains the molten metal. A conduit connects the piston cavity to the mold cavity. A first molten metal filter is located in the conduit for filtering the molten metal passing through the conduit during the reciprocating movement of the piston.

The molten metal intake may be a valve connected to the cylinder for providing fluid communication between the piston cavity and the molten metal in the holder furnace when the holder furnace contains the molten metal. The valve may be configured to open for inflow of the molten metal during a downstroke of the piston away from the bottom side of the mold, and configured to close during a return stroke of the piston toward the bottom side of the mold. A second molten metal filter may be used to cover the inlet to the valve for filtering the molten metal flowing into the piston through the valve during operation of the molten metal injector.

The cylinder of the injector may define an open end opposite the piston. The molten metal intake may be a gap formed between the piston and the open end of the cylinder during the reciprocating movement of the piston. The second molten metal filter may enclose the open end of the cylinder for filtering the molten metal flowing into the piston cavity through the gap during operation of the molten metal injector.

The molten metal intake may further be an aperture defined in a sidewall of the cylinder. The aperture may be open for inflow of the molten metal into the piston cavity during the reciprocating movement of the piston. The second molten metal filter may be used to cover the aperture for filtering the molten metal flowing into the piston cavity through the aperture during operation of the molten metal injector.

Furthermore, the molten metal intake may be a ball check valve incorporated into the piston for providing fluid communication between the piston cavity and the molten metal in the holder furnace when the holder furnace contains the molten metal. The ball check valve may be configured to open for inflow of the molten metal during a downstroke of the piston away from the bottom side of the mold, and configured to close during a return stoke of the piston toward the bottom side of the mold. The second molten metal filter may be used to cover the inlet to the ball check valve for filtering the molten metal flowing into the piston cavity through the ball check valve during operation of the molten metal injector.

The present invention is also a method of filtering molten metal in a molten metal injector for use with a casting mold having a mold cavity. The method preferably includes the steps of: providing a supply of molten metal; providing the molten metal injector, with the molten metal injector including a cylinder defining a piston cavity housing a reciprocating piston, and with at least one of the cylinder and piston including a molten metal intake for receiving molten metal from the supply of molten metal into the piston cavity; connecting the piston cavity to the mold cavity via a conduit; placing the molten metal injector in fluid communication with the supply of molten metal such that the cylinder and piston are at least partially submerged in the supply of molten metal; receiving the molten metal from the supply of molten metal into the piston cavity via the molten metal intake; pumping the molten metal from the piston cavity to the mold cavity through the conduit with the piston; and filtering the molten metal in the conduit before the molten metal enters the mold cavity.

In addition, the method may include the steps of: filtering the molten metal during the step of receiving the molten metal from the supply of molten metal into the piston cavity via the molten metal intake; and filtering the molten metal returning to the piston cavity through the conduit after the step of pumping the molten metal from the piston cavity to the mold cavity through the conduit with the piston.

Further, the method may include the steps of: placing a first molten metal filter in the conduit such that the step of filtering the molten metal in the conduit before the molten metal enters the mold cavity is performed by the first molten metal filter; covering the molten metal intake with a second molten metal filter; and filtering the molten metal with the second molten metal filter during the step of receiving the molten metal from the supply of molten metal into the piston cavity via the molten metal intake.

Further details and advantages of the present invention will become apparent from the following detailed description, in conjunction with the drawings, wherein like parts are designated with like reference numerals.

DETAILED DESCRIPTION OF THE PREFERRED EMBODIMENTS

Figure 1:
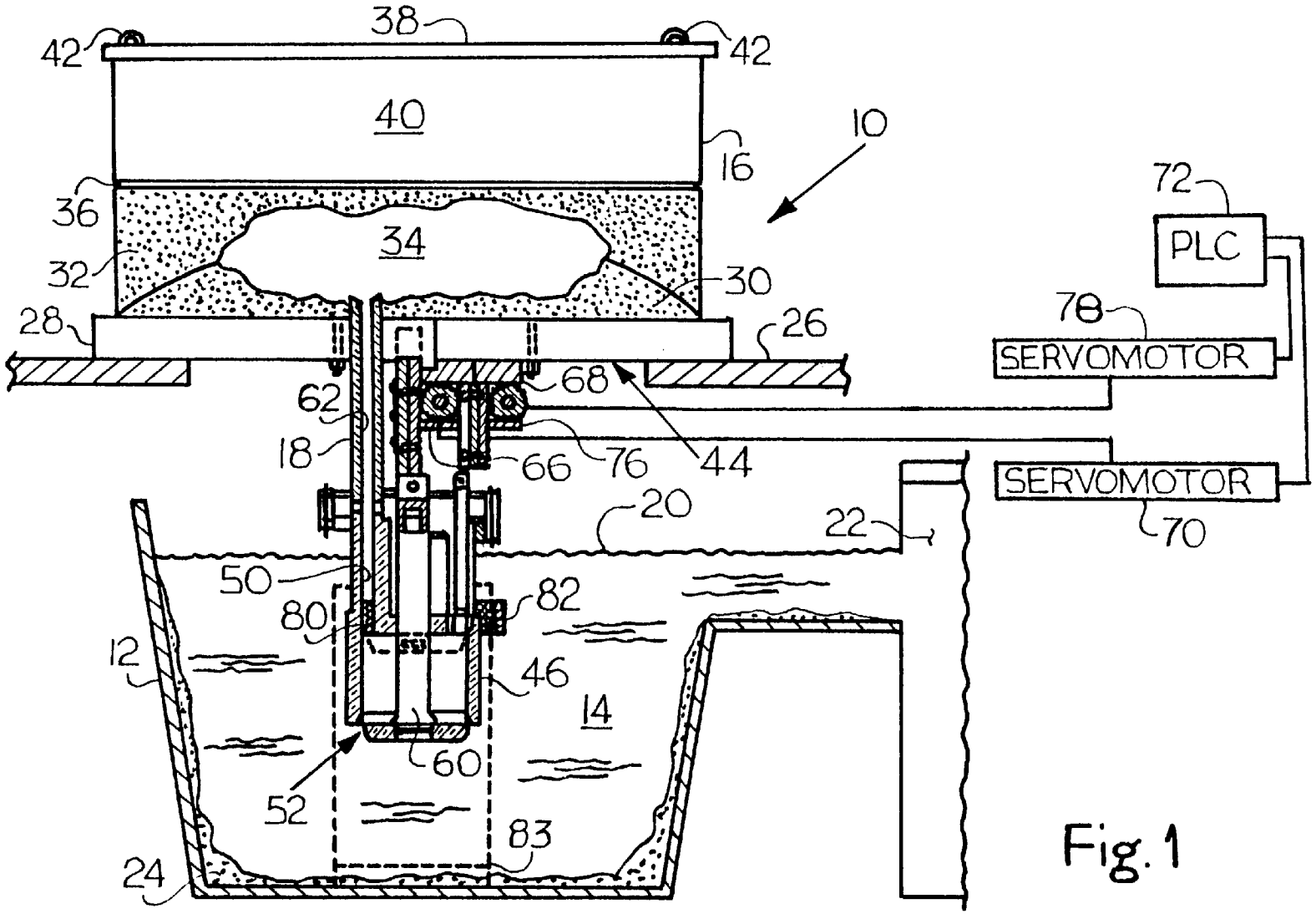
FIG. 1 is a partial cross-sectional side view of a filtering molten metal injector system according to the present invention.

FIG. 1 shows a molten metal injector system 10 in accordance with the present invention. The injector system 10 generally includes a holder furnace 12 that contains a supply of molten metal 14, such as molten aluminum alloy, a casting mold 16 positioned above the holder furnace 12, and at least one injector 18 supported from beneath the casting mold 16. The molten metal 14 contained in the holder furnace 12 may be exposed to the atmosphere, or enclosed by a cover (not shown). The molten metal 14 has a metal oxide film surface 20 formed at the top of the molten metal 14 when exposed to atmospheric conditions.

The holder furnace 12 is in fluid communication with a main melter furnace 22, which typically contains a large quantity of the molten metal 14 while the holder furnace 12 contains a much smaller quantity of the molten metal 14. For example, the main melter furnace 22 may contain about 30,000 pounds of the molten metal 14, while the holder furnace 12 contains about 2,000 pounds of the molten metal 14. The main melter furnace 22 maintains a steady supply of the molten metal 14 to the holder furnace 12 during operation of the injector system 10. When the molten metal 14 is a containment difficult molten metal, such as molten aluminum and molten aluminum alloys, the holder furnace 12 is preferably lined with refractory material 24 such as Sigma or Beta-II castable refractory material products manufactured by Permatec, Graham, N.C. Suitable refractory materials include low-density flowable refractory materials such as silicone based refractory materials, or higher density alumina-based refractory materials.

The casting mold 16 is supported by a support surface 26 such as the platform, i.e., lower platen, of a casting machine. The casting mold 16 is configured for casting ultra-large, thin-walled components such as those that may be used in ground transportation vehicles. An ultra-large, thin-walled component part for a ground transportation vehicle may have dimensions approaching 3 meters long, 1.7 meters wide, and 0.4 meters in depth, and the casting mold 16 would have a mold cavity configured accordingly. The casting mold 16 is preferably suitable for use with molten metal having a low melting point, such as aluminum and aluminum alloys. The casting mold 16 includes a holder frame 28. The support surface 26 is located a sufficient distance above the holder furnace 12 so that at least a portion of the injector 18 lies above the metal oxide film surface 20 of the molten metal 14. For example, the support surface 26 and, hence, the casting mold 16 may be positioned eighteen inches above the metal oxide film surface 20 of the molten metal 14.

The casting mold 16 generally includes a lower die 30 and an upper die 32, which together define a mold cavity 34. A cover plate 36 is positioned on top of the upper die 32. A top clamp plate 38 is separated from the cover plate 36 by a spacer block 40. Hoist rings 42 are preferably attached to the top clamp plate 38 for mold removal and installation. A bottom side 44 of the casting mold 16 faces the holder furnace 12. The upper die 32 is connected to the upper platen of the casting mold 16. After casting a part, the upper die 32 is raised with the cast part retained therein. When the casting mold 16 is fully open and means is provided to catch the cast part, the cast part may be ejected from the upper die 32.

Figure 6:
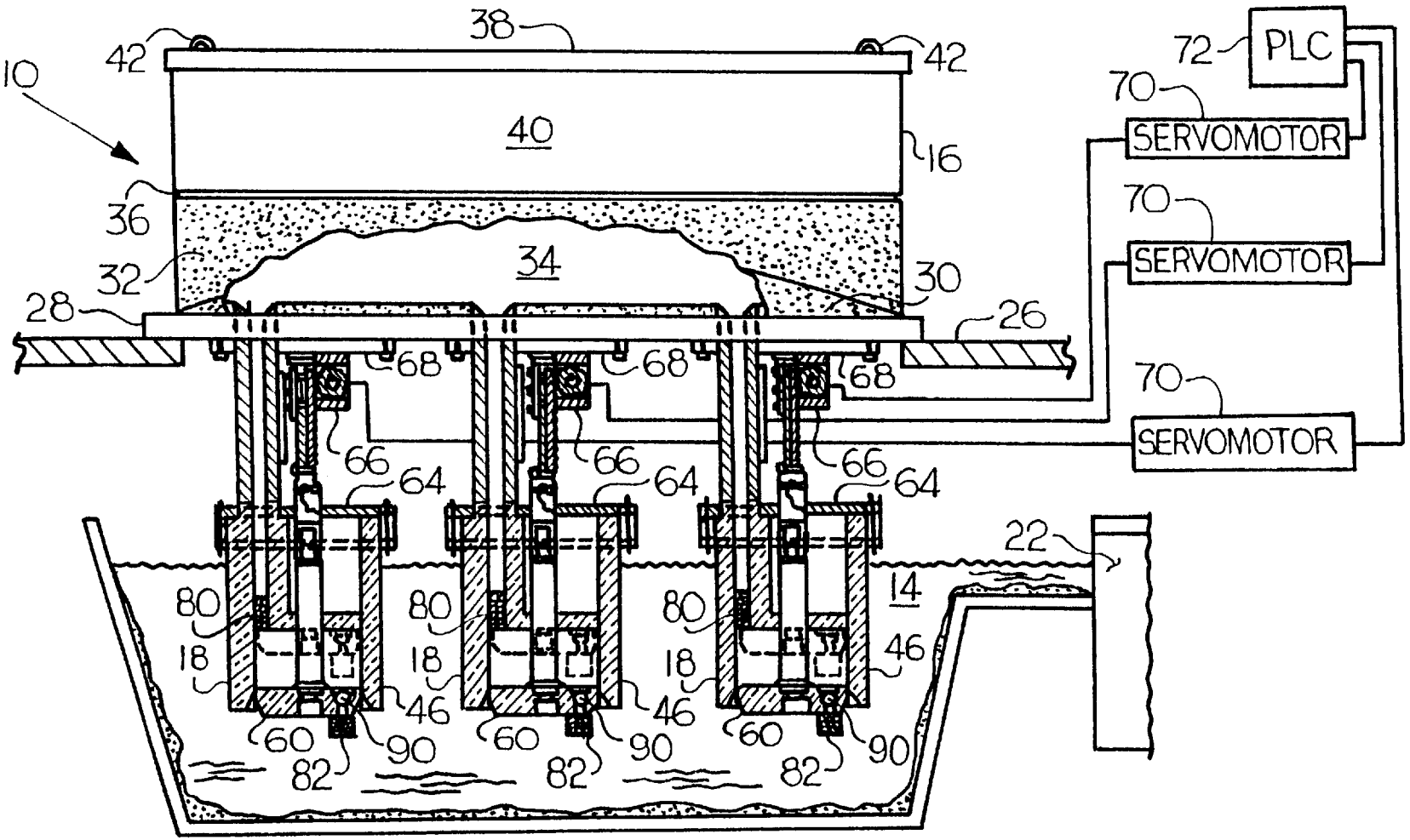
FIG. 6 is a partial cross-sectional view of the filtering molten metal injector system of FIG. 1 showing multiple injectors in accordance with the present invention.
Figure 7:
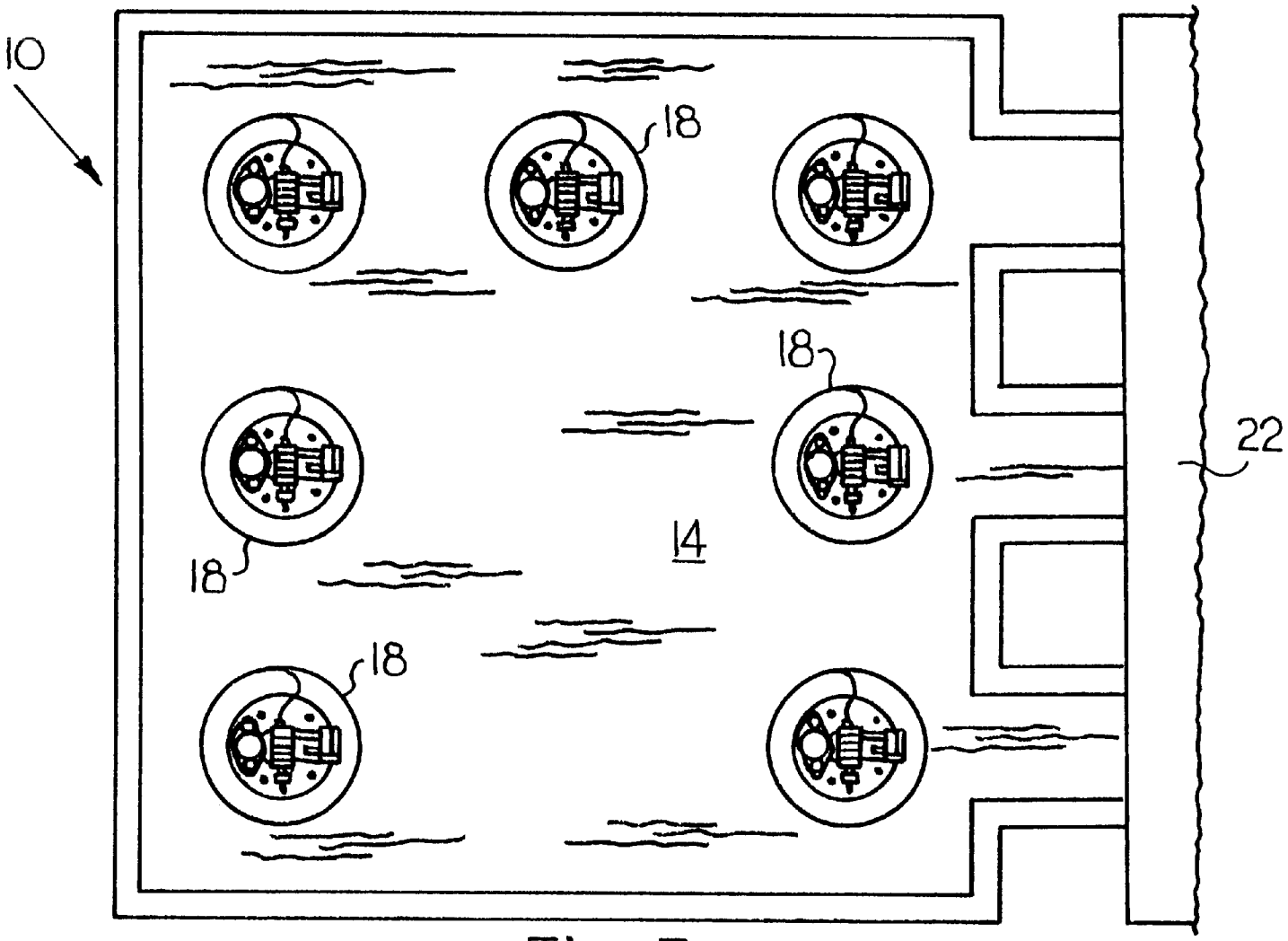
FIG. 7 is a cross-sectional plan view taken along lines VII—VII in FIG. 6.

In a preferred embodiment of the present invention, a plurality of injectors 18 is supported from the bottom side 44 of the casting mold 16, and projects downward into the holder furnace 12. However, in FIG. 1 only one injector 18 is shown for clarity and expediency in explaining the present invention. An arrangement of the present invention utilizing a plurality of the injectors 18 is shown in FIGS. 6 and 7, and discussed hereinafter.

Figure 2:
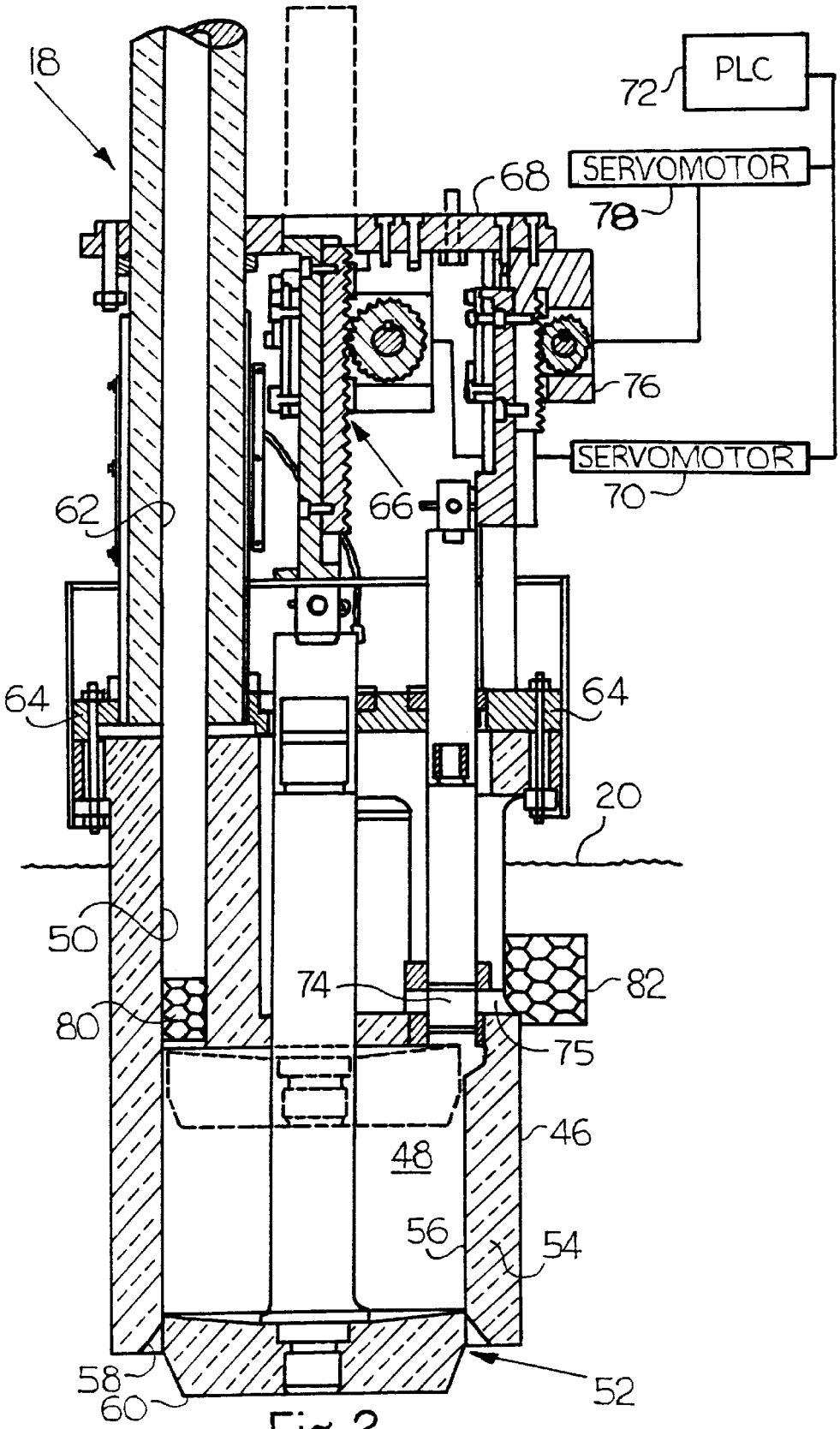
FIG. 2 is a cross-sectional view of an injector according to a first embodiment of the present invention for the molten metal injector system of FIG. 1.

FIG. 2 shows the details of the injector 18 according to a first embodiment of the present invention. Referring to FIGS. 1 and 2, the injector 18 includes a cylinder 46 for submerging in the molten metal 14 contained in the holder furnace 12. The cylinder 46 defines a piston cavity 48 and an injection conduit 50 in fluid communication with the piston cavity 48. The cylinder 46 includes a lower, open end 52 that is submerged in the molten metal 14 contained in the holder furnace 12. The cylinder 46 includes a sidewall 54 having an inner surface 56. The inner surface 56 of the cylinder 46 defines a tapered end surface 58 at the lower, open end 52 of the cylinder 46.

A piston 60 is positioned and movable in a reciprocating manner within the piston cavity 48. The piston 60 has approximately the same diameter as the piston cavity 48, with preferably a small clearance of about four millimeters with the inner surface 56 of the sidewall 54 of the cylinder 46. The piston 60 is movable in a reciprocating manner within the piston cavity 48 through a downstroke and a return stroke. As shown in FIG. 1, the downstroke, or filling stroke, of the piston 60 may be defined as a direction away from the bottom side 44 of the mold, and the return stroke, or pumping stroke, of the piston may be defined as a direction toward the bottom side 44 of the mold 16.

Using the above-defined convention, the piston 60 is shown approximately at a full downstroke position in solid lines in FIGS. 1 and 2, and approximately at a full return stroke position in broken lines in FIGS. 1 and 2. During the downstroke of the piston 60, the piston 60 preferably remains in contact with the inner surface 56 of the cylinder 46, or defines a minimal clearance therewith to substantially prevent inflow of the molten metal 14 into the piston cavity 46 through the lower, open end 52 of the cylinder 46. However, the total vertical distance the piston 60 may extend upward and downward may be controlled by a PLC (programmable logic controller) which controls a servomotor powering a lifting mechanism used for moving the piston 60 through its reciprocating motion, as discussed further hereinafter. Thus, this vertical distance is adjustable.

In view of the foregoing, the cylinder 46 and piston 60 are generally configured to pump the molten metal 14 upward during the return stroke of the piston 60 and permit inflow of the molten metal 14 into the piston cavity 48 during the downstroke of the piston 60. This configuration is used in each of the injector 18 embodiments discussed hereinafter. However, other arrangements for the cylinder 46 and piston 60 are envisioned by the present invention. For example, the cylinder 46 and piston 60 may be arranged such that the pumping stroke of the piston 60 is during the downstroke, and the filling or molten metal inflow stroke of the piston 60 is during the return stroke.

The cylinder 46 and piston 60 are preferably made of materials compatible with molten aluminum and molten aluminum alloys. In particular, suitable materials for the cylinder 46 and the piston 60 include graphite and high quality ceramic compounds such as Sialon and $Si_3N_4$. In addition, other suitable materials compatible with molten aluminum alloys include blends of $ZrO_2$ and BN. Further, the present invention envisions the use of both graphite and high quality ceramic compounds for the cylinder 46 and piston 60. Generally, all of the components of the injector 18 which may come in contact with the molten metal 14 are preferably made of materials compatible with molten aluminum and molten aluminum alloys, such as those listed hereinabove.

A fill tube 62 connects the injection conduit 50 defined by the cylinder 46 to the mold cavity 34. The fill tube 62 is connected to the injection conduit 50 and the cylinder 46 by a connecting flange 64. The fill tube 62 passes through the bottom side 44 of the casting mold 16 through a vertical opening in the holder frame 28 and the lower die 30. The injection conduit 50 and the fill tube 62 place the piston cavity 48 in fluid communication with the mold cavity 34. The fill tube 62 may be made of materials similar to those suitable for the cylinder 46 and piston 60, discussed previously. The injection conduit 50 and the fill tube 62 define a conduit that connects the piston cavity 48 to the mold cavity 34, and through which the molten metal 14 may flow from the holder furnace to the mold cavity 34.

The piston 60 is movable through the downstroke and return stroke by a lifting mechanism 66 that is attached to the cylinder 46 by the connecting flange 64. The lifting mechanism 66 is preferably a rack and pinion as shown in the various figures, but may also be a chain drive or other similar mechanical device. When the cylinder 46 and piston 60 are substantially submerged in the molten metal 14 contained in the holding furnace 12, the lifting mechanism 66 is preferably located above the metal oxide film surface 20 of the molten metal 14. For example, the lifting mechanism 66 may be located about fourteen inches above the metal oxide film surface 20 when the cylinder 46 and piston 60 are substantially submerged in the molten metal 14 contained in the holder furnace 12. The lifting mechanism 66 is attached to the bottom side 44 of the casting mold 16 by an upper flange 68. The upper flange 68 is further used to attach the injector 18 to the bottom side 44 of the casting mold 16. Any suitable type of mechanical fastener may connect the lifting mechanism 66 to the upper flange 68. Similarly, any suitable type of mechanical fastener may attach the upper flange 68 to the bottom side 44 of the casting mold 16. Thus, the injector 18 is attached to the casting mold 16 via the upper flange 68 and structural connections between the upper flange 68 and the connecting flange 64, i.e., the lifting mechanism 66.

Due to the close proximity of the lifting mechanism 66 to the holder furnace 12, the lifting mechanism 66 is subjected to high temperatures. Therefore, the lifting mechanism 66 is preferably made of a material capable of withstanding temperatures on the order of 600–1000° F. Suitable materials for the lifting mechanism 66 include those discussed previously that are compatible with molten aluminum alloys, as well as steel and other ferrous metals since the lifting mechanism 66 does not directly contact the molten metal 14 in the holder furnace 12.

A remotely controlled servomotor 70 may drive the rack and pinion, which forms the lifting mechanism 66. The servomotor 70 may be controlled by a programmable logic controller, PLC 72, or programmable computer, which is programmable to adjust the vertical distance the piston 60 may travel during its downstroke and, further, during its return stroke. For example, in the injector of FIG. 2, the lifting mechanism 66 may be controlled to allow the piston 60 to move downward to a point just before a gap forms between the piston 60 and the tapered end surface 58 of the cylinder 46, and controlled to allow the piston 60 to move upward to a point where the injection conduit 50 is closed off the piston 60, i.e., a full return stroke position. Alternatively, when it is time to perform routine maintenance on the injector 18 or replace the injector 18, the holder furnace 12 may be emptied of the molten metal 14 or removed completely, and the lifting mechanism 66 set to allow the piston 60 to form a gap with the tapered end surface 58 of the cylinder 46. The gap would permit any molten metal 14 retained in the piston cavity 48 to drain out of the piston cavity 48 before the injector 18 is repaired or replaced.

In the first embodiment of the injector 18 shown in FIG. 2, a valve 74 is connected to the cylinder 46 for receiving the molten metal 14 contained in the holder furnace 12 into the piston cavity 48. The valve 74 may be a simple inlet valve, i.e., on/off valve. The valve 74 operates as a molten metal intake to the injector 18. The valve 74 is preferably connected to the cylinder 46 such that with the cylinder 46 and piston 60 at least partially submerged in the molten metal 14, the valve 74 is located below the metal oxide film surface 20 in the holder furnace 12. For example, in a preferred embodiment of the injector 18 shown in FIG. 2, the valve 74 and, more particularly, an inlet 75 to the valve 74 is located about fourteen inches below the metal oxide film surface 20 in the holder furnace 12. The valve 74 provides for fluid communication between the piston cavity 48 and the molten metal 14 contained in the holder furnace 12.

The valve 74 is configured to open approximately at the beginning of the downstroke of the piston 60 to permit inflow of the molten metal 14 into the piston cavity 48, and close during the return or pumping stroke of the piston 60. In particular, the valve 74 is preferably open fully throughout the downstroke of the piston 60, closes when the piston 60 completes a downstroke, and remains closed during the return or the pumping stroke of the piston 60. The valve 74 is opened and closed by a valve controller 76. The valve controller 76 is preferably a rack and pinion operatively connected to the valve 74. A remotely controlled servomotor 78 may operate the valve controller 74. In addition, the valve controller 74 may be a pneumatic operated rotary actuator, or other similar actuators known in the art. The servomotor 78 may be controlled by the same PLC 72 that controls the lifting mechanism 66, as will be appreciated by those skilled in the art, or controlled independently therefrom. The lifting mechanism 66 and the valve controller 76 may also be manually controlled. The valve 74 may be constructed using the same materials compatible with molten aluminum and molten aluminum alloys discussed previously.

The injector 18 further includes a first molten metal filter 80 positioned within the injection conduit 50 or the fill tube 62, which together define the conduit connecting the piston cavity 48 to the mold cavity 34. The molten metal filter 80 is configured to filter the molten metal 14 passing through the injection conduit 50 and the fill tube 62 during the reciprocating movement of the piston 60. In particular, the first molten metal filter 80 filters the molten metal 14 flowing upward in the injection conduit 50 and the fill tube 62 during the return stroke of the piston 60. The first molten metal filter 80 may then filter the molten metal 14 retained in the injection conduit 50 and the fill tube 62, if any, a second time after the return stroke is completed, i.e., during the downstroke. This retained molten metal 14 is filtered as it flows downward toward the piston cavity 48 during the downstroke of the piston 60. Thus, the first molten metal filter 80 may provide two stages of filtering during one complete injection cycle of the piston 60, i.e., a downstroke followed by a return stroke.

A second molten metal filter 82 is preferably used to cover the inlet 75 to the valve 74 to filter and remove debris from the molten metal 14 flowing into the piston cavity 48 through the valve 74 during the downstroke of the piston 60. The first molten metal filter 80, discussed above, may be used alone in the injector 18 of FIG. 2, or in combination with the second molten metal filter 82. The second molten metal filter 82 provides an initial stage of filtering for the molten metal 14 flowing into the piston cavity 48. The first and second molten metal filters 80, 82 together provide multiple stages of molten metal filtering before the molten metal 14 is injected into the mold cavity 34 of the mold 16, which eliminates or reduces the size and quantity of molten metal oxides, i.e., particulates, entering the mold cavity 34. A better quality cast product will thus result. The first and second molten metal filters 80, 82 may be rated at 50–80 micron filters, for example and manufactured by Metalices, Inc. and are No. 6 grit. Substantially equivalent foam filters may also be used for the first and second molten metal filters 80, 82.

The present invention further envisions that the second molten metal filter 82 may be physically separate from the injector 18. As shown in broken lines in FIG. 1 and now designated with reference numeral "83", the second molten metal filter 83 may be provided as a "basket" located in the holder furnace 12. The injector 18 may extend downward from the casting mold 16 to cooperate with the second molten metal filter 83 during operation of the injector 18. Thus, the second molten metal filter 83 may be attached to the bottom of the holder furnace 12. Alternatively, the entire injector 18 may be enclosed within the basket-shaped second molten metal filter 83, with the second molten metal filter 83 attached to the bottom side 44 of the casting mold 16. The foregoing embodiments of the second molten metal filter 83 may be used in any of the injector 18 embodiments of the present invention.

Figure 3:
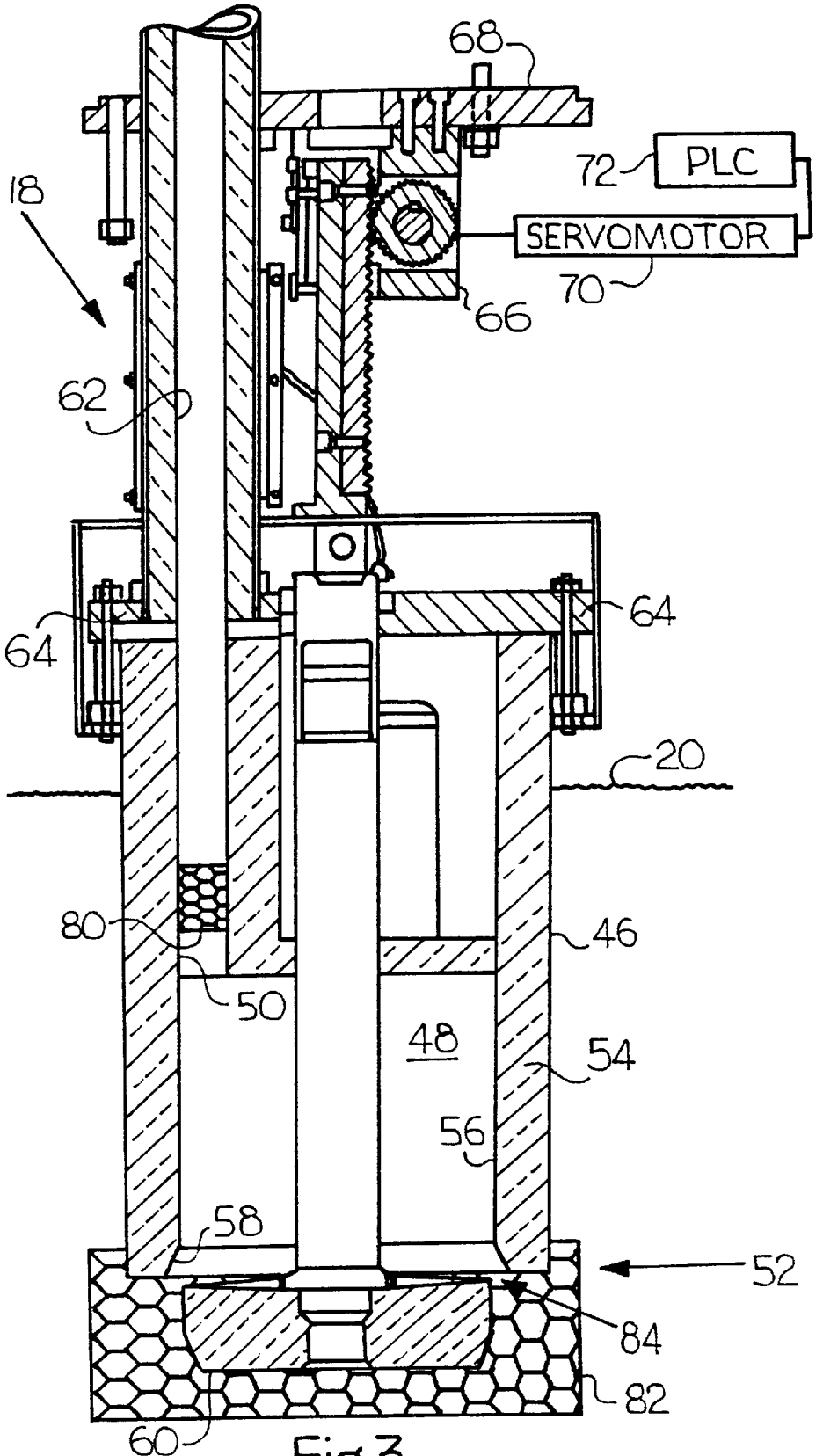
FIG. 3 is a cross-sectional view of the injector according to a second embodiment of the present invention for the molten metal injector system of FIG. 1.

FIG. 3 shows a second embodiment of the injector 18 according to the present invention. Referring to FIGS. 1–3, the injector 18 of FIG. 3 is substantially similar to the injector 18 of FIG. 2, but now the molten metal intake to the piston cavity 48 is defined by a gap 84 formed generally between the piston 60 and the lower, open end 52 of the cylinder 46 during the reciprocating movement of the piston 60. In particular, the gap 84 is typically formed between the piston 60 and the tapered end surface 58 during the downstroke of the piston 60. As discussed previously, the total vertical distance the piston 60 travels during the downstroke and return stroke may be controlled by the PLC 72 controlling the servomotor 70 driving the lifting mechanism 66. Hence, the size of the gap 84 may be changed as deemed to regulate the rate of inflow of the molten metal 14 into the piston cavity 48. The gap 84 is preferably sized such that there is little or no initiation of turbulent molten metal flow into the piston cavity 48, which could disturb the metal oxide film surface 20 of the molten metal 14 in the holder furnace 12 or cause metal oxides to form while the molten metal 14 flows into the piston cavity 48. The tapered end surface 58 facilitates the formation of the gap 84, and further provides a centering guide for the piston 60 during the return stroke of the piston 60 so that the piston 60 is smoothly guided into the piston cavity 48 during its upward movement. The tapered end surface 58 also facilitates draining molten metal from the piston cavity 48 when the injector 18 is in need of repair or replacement.

The injector 18 of FIG. 3 includes the first molten metal filter 80 located within the injection conduit 50 or the fill tube 62. As discussed previously, the injection conduit 50 and the fill tube 62 define the conduit connecting the piston cavity 48 to the mold cavity 34. However, the second molten metal filter 82 is now configured as a sleeve that encloses the lower, open end 52 of the cylinder 46. As will be appreciated by those skilled in the art, the second molten metal filter 82 preferably extends sufficiently downward past the lower, open end 52 of the cylinder 46 to allow the piston 60 to form the gap 84 with the tapered end surface 58 of the cylinder 46. The first molten metal filter 80 may be used alone in the second embodiment of the injector 18 shown in FIG. 3, or used in combination with the second molten metal filter 82 to provide multiple stages of molten metal filtering, as discussed previously.

Figure 4:
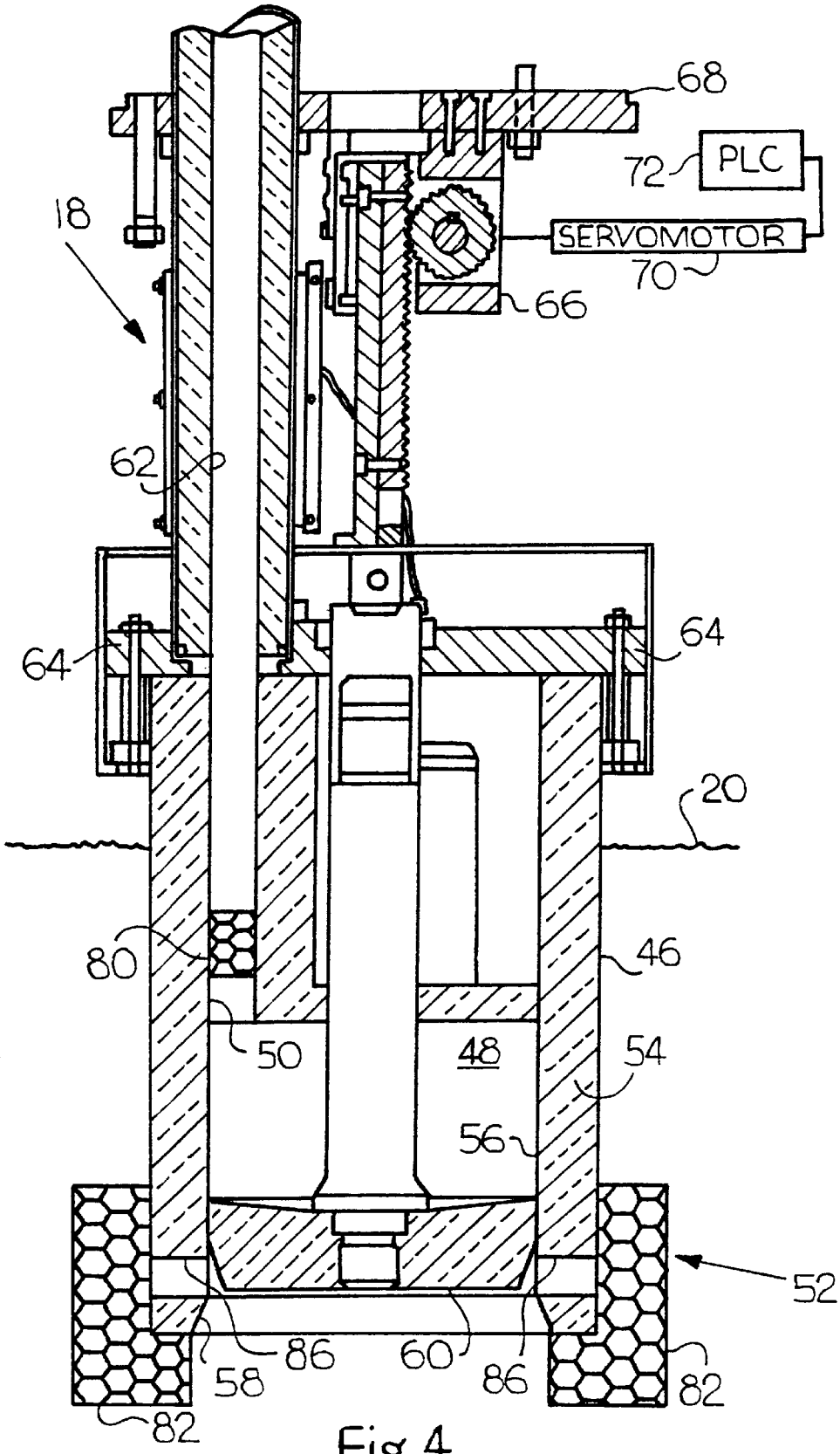
FIG. 4 is a cross-sectional view of the injector according to a third embodiment of the present invention for the molten metal injector system of FIG. 1.

FIG. 4 shows a third embodiment of the injector 18. Referring to FIGS. 1–4, the injector 18 of FIG. 4 is substantially similar to the injectors discussed previously, but now the molten metal intake is defined by apertures 86 formed in the sidewall 54 of the cylinder 46. The injector 18 shown in FIG. 4 includes two apertures 86 formed at opposite sides of the cylinder 46, but it will be appreciated by those skilled in the art that at a minimum only one aperture 86 is necessary, and more than two apertures 86 may be utilized in accordance with the present invention. The piston 60 shown in FIG. 4 is formed in a similar fashion to the piston 60 of the injector 18 shown in FIG. 2, discussed previously.

The apertures 86 located in the sidewall 54 of the cylinder 46 are open for inflow of the molten metal 14 during the reciprocating movement of the piston 60. In particular, the apertures 86 are located in the sidewall 54 of the cylinder 46 such that when the piston 60 moves through a downstroke the apertures 86 are open for inflow of the molten metal 14. As shown in FIG. 4, the apertures 86 are preferably located substantially at the bottom of the lower, open end 52 of the cylinder 46. In this position, the apertures 86 thus begin to open for inflow of the molten metal 14 into the piston cavity 48 as the piston 60 completes a downstroke in which the top of the piston 60 is substantially co-extensive with the tapered end surface 58. However, in the injector 18 of FIG. 4 it is preferred that the piston 60 not extend downward to a point where a gap would form between the piston 60 and the tapered end surface 58 of the cylinder 46. The total vertical distance the piston 60 travels during the downstroke and return stroke, as discussed previously, may be controlled so that the piston 60 does not extend below the lower, open end 52 of the cylinder 46, other than when it is desirable to drain molten metal from the piston cavity 48. During the return stroke of the piston 60, the piston 60 moves upward and will close-off the apertures 86 to further inflow of the molten metal 14 into the piston cavity 48. As the piston 60 moves upward, the molten metal 14 received within the piston cavity 48 is injected into the injection conduit 50 and the fill tube 62 for ultimate injection into the mold cavity 34.

The injector 18 of FIG. 4 further includes the first molten metal filter 80 located within the injection conduit 50 or the fill tube 62. However, in the injector 18 of FIG. 4, respective second molten metal filters 82 are provided for covering the apertures 86 leading to the piston cavity 48 at the downstroke position of the piston 60. The first molten metal filter 80 may be used alone in the injector 18 shown in FIG. 3, or used in combination with the second molten metal filters 82 to provide multiple stages of molten metal filtering in a similar manner to the previously discussed embodiments of the injector 18.

Figure 5:
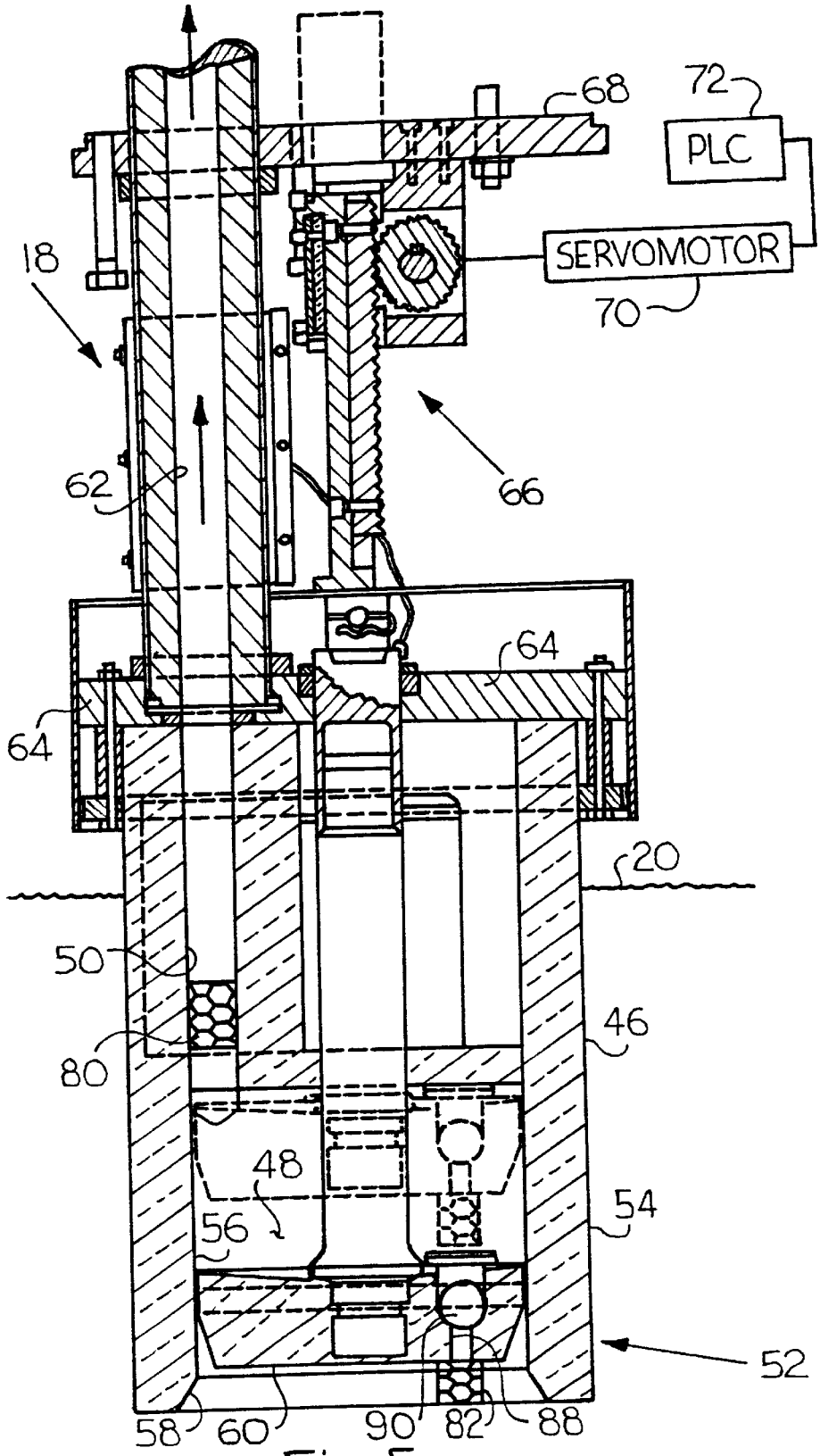
FIG. 5 is a cross-sectional view of the injector according to a fourth embodiment of the present invention for the molten metal injector system of FIG. 1.

Referring to FIG. 5, a fourth embodiment of the injector 18 is shown. In the fourth embodiment of the injector 18, the molten metal intake is an aperture 88 defined in the piston 60 which houses a ball check valve 90. Referring to FIGS. 1–5, the ball check valve 90 provides for fluid communication between the piston cavity 48 and the molten metal 14 in the holder furnace 12 in a similar manner to the valve 74 of the injector 18 shown in FIG. 2, discussed previously. However, the ball check valve 90 does not require the operating mechanism, i.e., valve controller 76, necessary to operate the valve 74.

The ball check valve 90 is generally configured to permit inflow of the molten metal 14 from the holder furnace 12 during the downstroke of the piston 60, and prevent inflow of the molten metal 14 during the return or pumping stroke of the piston 60. In particular, the ball check valve 90 is substantially open for inflow of the molten metal 14 into the piston cavity 48 as the piston 60 begins its downstroke. The ball check valve 90 then remains open until the piston 60 completes a downstroke and begins a return stroke. The total vertical distance the piston 60 travels, as discussed previously, may be controlled so that the piston 60 does not extend below the lower, open end 52 of the cylinder 46 to form a gap with tapered end surface 58, other than when it is desirable to drain molten metal from the piston cavity 48. The ball check valve 90 may be constructed using the same materials compatible with molten aluminum and molten aluminum alloys discussed previously.

The fourth embodiment of the injector 18 also includes the molten metal filter 80 located within the injection conduit 50 or the fill tube 62. However, the second molten metal filter 82 now covers the aperture 88 leading to the ball check valve 90. The first molten metal filter 80 may be used alone in the fourth embodiment of the injector 18 shown in FIG. 5, or used in combination with the second molten metal filter 82 to provide multiple stages of molten metal filtering, in a similar manner to the previously discussed embodiments of the injector 18.

In each of the foregoing embodiments, the flow area defined by the second molten metal filters 82 is preferably made much larger than the flow area into the piston cavity 48, i.e., the flow area defined by the various molten metal intakes, to avoid impeding molten metal flow into the piston cavity 48. Thus, the flow area of the second molten metal filters 82 is large in comparison to the flow area defined by the various molten metal intakes to the piston cavity 48. However, the filter strainer size is made small enough in the second molten metal filters 82 to filter most metal oxide particles before they enter the piston cavity 48.

Referring again to FIG. 1, the injector 18 of the present invention, for each of the injector 18 embodiments described hereinabove, advantageously locates the molten metal intake to the piston cavity 48 well below the metal oxide film surface 20 of the molten metal 14 contained in the holder furnace 12. Since the molten metal intake is located below the metal oxide film surface 20, the metal oxide film surface 20 remains substantially undisturbed during operation of the injector 18. The molten metal intake is always located in an area of clean molten metal flow. This assures that the disturbances to the metal oxide film surface 20 are minimized and substantially prevents metal oxides from being pulled into the piston cavity 48 from the metal oxide film surface 20. In addition, because the piston cavity 48 is filled during the downstroke of the piston 60, the possibility of forming metal oxides in the piston cavity 48 due to the action of the piston 60 is minimized.

The "upward" pumping stroke of the present invention is a substantial improvement over prior art piston-cylinder arrangements in which the pumping stroke of the piston-cylinder arrangement is generally in a downward direction toward the bottom of a supply tank of the molten metal in which these prior art piston-cylinder arrangements are typically located. The downward pumping strokes of the prior art piston-cylinder arrangements have a tendency to disturb the metal oxide film surface of the molten metal contained in the supply tank. In particular, the downward pumping stroke of these prior art piston-cylinder arrangements often causes a partial vacuum to form below the metal oxide film surface in the supply tank, which draws metal oxide particulates from the metal oxide film surface downward into the cylinder. In addition, the downward pumping strokes used in these prior art piston-cylinder arrangements have the further disadvantage of creating disturbances within the cylinder due to the action of the piston, which often cause metal oxides to form within the cylinder due to the action of the downward directed piston. The injector 18 of the present invention overcomes the foregoing disadvantages.

Referring to FIGS. 6 and 7, an exemplary casting cycle of the injector system 10 of the present invention will now be discussed. Each of the injectors 18 shown in FIG. 6 is identical to the injector 18 discussed hereinabove in connection with FIG. 5. However, the injectors 18 used in the injector system 10 shown in FIG. 6 may be any one of the injector embodiments discussed previously. A casting cycle may commence, for example, with the piston 60 of each of the injectors 18 located at a substantially full downstroke position. At this position, the molten metal intake to each injector 18, in this case ball check valve 90, is closed and prevents inflow of the molten metal 14 into the piston cavity 48. The piston cavity 48 of each injector 18 is typically completely filled with the molten metal 14. The lifting mechanism 66 of each injector 18 is engaged by the PLC 72 controlling the servomotor (not shown) driving the lifting mechanism 66. The lifting mechanism 66 begins the injection stroke, or return stroke of the piston 60. This follows a prespecified or preprogrammed position versus time path entered into the PLC 72. During the injection stroke, the molten metal 14 received in the piston cavity 48 of each injector 18 is pumped upward by the piston 60 into the respective injection conduits 50, the fill tubes 62, and, ultimately, into the mold cavity 34. When the mold cavity is filled with the molten metal 14, pressure builds and the servomotors 70 driving the respective lifting mechanisms 66 can no longer follow the prespecified position versus time path. The PLC 72 abruptly changes to a torque holding condition. The torque holding condition reflects a pressure intensification of between about 5 to 45 psi in the mold cavity 34. The torque holding condition is maintained for a sufficient period of time to allow the molten metal 14 received in the mold cavity 34 to solidify. Thereafter, the piston 60 of each injector 18 is lowered and the molten metal intake, i.e., the ball check valve 90, permits inflow of the molten metal 14 into the piston cavity 48. The injector 18 embodiments shown in FIGS. 2–4 will operate in a substantially similar manner to the foregoing, with the previously discussed differences as to how the various molten metal intakes operate to allow molten metal to flow in the piston cavity 48 of the respective injector 18 embodiments.

The piston 60 of each injector 18 may be stopped prior to reaching a full return stroke position if the torque holding condition occurs indicating that the mold cavity 34 is filled with the molten metal 14. As will be apparent to those skilled in the art, the PLC 72 "servocontroller" may be programmed to adjust the rate of injection of the molten metal 14 into the piston cavity 48 and, consequently, the rate at which the molten metal 14 is received into the piston cavity 48. The torque holding condition is continually monitored by the PLC 72, and the PLC 72 commands are based upon this information. Further, it will be apparent to those skilled in the art that the PLC 72 may be programmed to sequence the injection of the molten metal 14 into the mold cavity 34 by sequencing the injectors 18 to begin injection operations at different times and at different rates. The molten metal 14 is generally injected into the mold cavity 34 under low pressure, i.e., less than about 15 psi.

The second molten metal filter 82 is preferably included to filter the molten metal flowing into the piston cavity 48 during the "filling" downstroke of the piston 60 of each injector 18. The first molten metal filter 80 is preferably used during the return or pumping stroke of the piston 60 of each injector 18 to perform a second stage of molten metal filtering. In addition, the first molten metal filter 80 may be used to filter any "retained" molten metal 14 flowing back to the piston cavity 48 after the return or pumping stroke of the piston 60 of each injector 18. Thus, it is possible to filter the molten metal up to three times during a single injection cycle (i.e., downstroke and return stroke) of the injectors 18. An additional injection cycle may also include operating the piston 60 through a downstroke and return stroke with the molten metal intake open for inflow of molten metal throughout the downstroke and return stroke. This provides a "flushing action" for the piston cavity 48 in which the molten metal "wipes" the inner surface 56 of the piston cavity 48 free of debris and deposits.

In view of the foregoing, the present invention is a method of filtering molten metal in a molten metal injector for use with a casting mold having a mold cavity. The method includes the steps of: providing a clean supply of molten metal; providing the molten metal injector, with the molten metal injector including a cylinder defining a piston cavity housing a reciprocating piston, and with at least one of the cylinder and piston including a molten metal intake for receiving molten metal from the supply of molten metal into the piston cavity; connecting the piston cavity to the mold cavity via a conduit; placing the molten metal injector in fluid communication with the supply of molten metal such that the cylinder and piston are at least partially submerged in the supply of molten metal; receiving the molten metal from the supply of molten metal into the piston cavity via the molten metal intake; pumping the molten metal from the piston cavity through the conduit to the mold cavity with the piston; and filtering the molten metal in the conduit before the molten metal enters the mold cavity.

The method may further include the steps of: filtering the molten metal during the step of receiving the molten metal from the supply of molten metal into the piston cavity via the molten metal intake; and filtering the molten metal returning to the piston cavity through the conduit after the step of pumping the molten metal from the piston cavity to the mold cavity through the conduit with the piston. In addition, the method may include the steps of: placing a first molten metal filter in the conduit such that the step of filtering the molten metal in the conduit before the molten metal enters the mold cavity is performed by the first molten metal filter; covering the molten metal intake with a second molten metal filter; and filtering the molten metal with the second molten metal filter during the step of receiving the molten metal from the supply of molten metal into the piston cavity via the molten metal intake.

The present invention provides a molten metal injector system and method for casting inexpensive, but high quality, thin-walled components. The injector system of the present invention may be applied to cast complex components as a single piece, which could be used to replace traditional stamping assemblies made from multiple stamped components. In addition, the injector system of the present invention provides an injector having multiple stages of filtering, which reduces or eliminates the introduction of metal oxides into the mold cavity of a casting mold. A better quality cast product is thus produced by the molten metal injector system and method of the present invention.

While the preferred embodiments of the present invention were described hereinabove, obvious modifications and alterations of the present invention may be made without departing from the spirit and scope of the present invention. The scope of the present invention is defined in the appended claims and equivalents thereto.

We claim:

1. A molten metal injector system, comprising:

a holder furnace for containing a supply of molten metal;

a casting mold supported above the holder furnace and having a bottom side facing the holder furnace, the mold defining a mold cavity for receiving the molten metal from the holder furnace; and a molten metal injector supported from the bottom side of the mold and projecting into the holder furnace, the molten metal injector further comprising:

a cylinder defining a piston cavity housing a reciprocating piston movable through a downstroke and a return stroke for pumping molten metal upward from the holder furnace and injecting the molten metal into the mold cavity, the piston and cylinder positioned to be at least partially submerged in molten metal when the holder furnace contains the supply of molten metal, and the cylinder defining an open end opposite the piston, the piston defining a gap with the open end of the cylinder during the downstroke of the piston for receiving molten metal into the piston cavity;

a fill conduit connecting the piston cavity to the mold cavity; and a first molten metal filter located in the fill conduit for filtering the molten metal passing through the fill conduit during the reciprocating movement of the piston.

2. The injector system of claim 1, further including a second molten metal filter enclosing the open end of the cylinder for filtering the molten metal flowing into the piston cavity through the gap formed during the downstroke of the piston.

3. An injector for supplying molten metal to a mold cavity of a casting mold, comprising:

a cylinder for at least partially submerging in a supply of molten metal, the cylinder defining a piston cavity;

a reciprocating piston located in the piston cavity and movable through a downstroke and a return stoke for pumping molten metal received into the piston cavity to the casting mold;

a fill conduit in fluid communication with the piston cavity and configured for connection to the casting mold; and a first molten metal filter located in the fill conduit for filtering the molten metal passing through the fill conduit during the reciprocating movement of the piston when the cylinder and piston are at least partially submerged in the supply of molten metal, wherein the cylinder defines an open end opposite the piston, the piston defining a gap with the open end of the cylinder during the downstroke of the piston for receiving molten metal into the piston cavity.

4. The injector of claim 3, further including a second molten metal filter enclosing the open end of the cylinder for filtering the molten metal flowing into the piston cavity through the gap formed during the downstroke of the piston.

* * * * *